US009687969B2

(12) United States Patent
Wang

(10) Patent No.: US 9,687,969 B2
(45) Date of Patent: Jun. 27, 2017

(54) WRENCH

(71) Applicants: Hangzhou Great Star Tools Co., Ltd., Hangzhou (CN); Hangzhou Great Star Industrial Co., Ltd., Hangzhou (CN)

(72) Inventor: Min Wang, Hangzhou (CN)

(73) Assignees: Hangzhou Great Star Tools Co., Ltd., Hangzhou (CN); Hangzhou Great Star Industrial Co., Ltd., Hangzhou (CN)

( * ) Notice: Subject to any disclaimer, the term of this patent is extended or adjusted under 35 U.S.C. 154(b) by 270 days.

(21) Appl. No.: 14/369,996

(22) PCT Filed: Apr. 3, 2013

(86) PCT No.: PCT/CN2013/073737
§ 371 (c)(1),
(2) Date: Oct. 16, 2014

(87) PCT Pub. No.: WO2014/161187
PCT Pub. Date: Oct. 9, 2014

(65) Prior Publication Data
US 2015/0122086 A1 May 7, 2015

(51) Int. Cl.
*B25B 13/46* (2006.01)
*B25B 17/00* (2006.01)

(52) U.S. Cl.
CPC ..... *B25B 13/467* (2013.01); *B25B 13/465* (2013.01); *B25B 17/00* (2013.01)

(58) Field of Classification Search
CPC ..... B25B 13/465; B25B 13/467; B25B 17/00
See application file for complete search history.

(56) References Cited

U.S. PATENT DOCUMENTS 2,520,443 A * 8/1950 Seaquist ..... B25B 17/00 475/270
3,467,231 A * 9/1969 Haznar ..... B25B 13/465 192/43.1

(Continued)

FOREIGN PATENT DOCUMENTS

CN 2124110 U 12/1992
CN 101337342 A 1/2009

(Continued)

OTHER PUBLICATIONS

Wikipedia Entry for Epicyclic Gearing, Nov. 7, 2012.*
International Search Report for PCT/CN2013/073737 dated Jan. 2, 2014.

*Primary Examiner* — David B Thomas
(74) *Attorney, Agent, or Firm* — Fitch, Even, Tabin & Flannery LLP

(57) ABSTRACT

The present invention provides a wrench, which comprises a working part and a handle, the working part includes a main axle perpendicular to the handle and mutually cooperated bidirectional pawl and ratchet wheel, in which the ratchet wheel is arranged so as to be caused by the handle, the bidirectional pawl is arranged to rotate the main axle and has a first pawl and a second pawl which are opposite to the clutch direction between the ratchet wheel, the working part also includes a direction switching mechanism for setting clutch direction of the bidirectional pawl and the ratchet wheel; the direction switching mechanism is arranged such that a first pawl and a second pawl are engaged with the ratchet wheel selectively, such that when handle is rotated in the direction set by the direction switching mechanism, the ratchet wheel is engaged with the bidirectional pawl, then rotates the main axle; when the handle is rotated in the direction opposite to the direction set by the direction switching mechanism, the ratchet wheel and the bidirec- (Continued)

tional pawl slide over each other, and the main axle remains stationary; the working part also includes a planetary gear speed increasing mechanism acting on the main axle, the planetary gear speed increasing mechanism includes a sun gear, a planetary gear and a ring gear, in which the sun gear is arranged to rotate the main axle together, the rotation ring is arranged so as to cause the planetary gear to rotate, the gear ring is fixedly connected with the handle, so that when the handle is gripped and the rotation ring is rotated, the planetary gear speed increasing mechanism increases the speed of the rotation inputted by the rotation ring and then outputs via the main axle.

7 Claims, 7 Drawing Sheets

(56) References Cited

U.S. PATENT DOCUMENTS

| | | | | |
|---|---|---|---|---|
| 3,587,364 | A * | 6/1971 | Peyre | B25B 13/467 74/142 |
| 3,945,274 | A * | 3/1976 | Annett, II | B25B 13/463 81/58.1 |
| 4,448,095 | A | 5/1984 | Blodgett et al. | |
| 4,762,032 | A * | 8/1988 | Chow | B25B 23/0035 81/62 |
| 5,009,132 | A | 4/1991 | Gilberto | |
| 6,681,660 | B2 | 1/2004 | Foard | |
| 7,168,340 | B1 * | 1/2007 | Green | B25B 13/465 81/57.3 |
| 7,536,934 | B1 * | 5/2009 | Tatangelo | B25B 13/463 81/57.22 |
| 7,770,494 | B2 * | 8/2010 | Cornwell | B25B 13/467 81/57.3 |
| 8,991,285 | B2 * | 3/2015 | Mennecke, IV | B25B 13/465 81/57.3 |
| 2002/0152847 | A1 | 10/2002 | Foard | |
| 2013/0139653 | A1 * | 6/2013 | Mennecke, IV | B25B 13/465 81/58.1 |

FOREIGN PATENT DOCUMENTS

| | | | |
|---|---|---|---|
| CN | 201511320 | U | 6/2010 |
| CN | 102145477 | A | 8/2011 |
| CN | 102259321 | A | 11/2011 |
| CN | 202742273 | U | 2/2013 |
| CN | 203245777 | U | 10/2013 |
| DK | 1775073 | T3 | 4/2007 |
| EP | 1775073 | A1 | 4/2007 |

* cited by examiner

WRENCH

FIELD OF THE INVENTION

The present invention relates to a wrench, and pertains to the field of hand tools.

DESCRIPTION OF THE PRIOR ART

When using an ordinary wrench, due to the hand gripping the handle can only rotate a small angle, so that when one needs to consecutively rotate one component for multiple times, a halt is needed to allow the hand to rotate an angle in the opposite direction. Sometimes the wrench is taken away temporarily from the component to allow rotation in the opposite direction. In this way the operator needs to align the wrench to the component again. Sometimes the rotation in the opposite direction is achieved by releasing the hand gripping the handle with the help of the other hand, and such operation is very inconvenient.

In addition, when under low torque output conditions, the working efficiency of the wrench is significantly improved if the component can be rotated as soon as possible.

Therefore, the person skilled in the art is committed to developing a wrench which can rotate the component as soon as possible under low torque output conditions, and the other hand can also be used to grip the handle and rotate back and forth continuously to tighten or loosen the component quickly without pausing meanwhile.

SUMMARY OF THE INVENTION

In order to achieve the above objects, the present invention provides a wrench, including a working part and a handle, the working part includes a main axle, a bidirectional pawl and a ratchet wheel, the main axle is perpendicular to the handle, and the bidirectional pawl and the ratchet wheel are mutually cooperated, in which the ratchet wheel is arranged to be driven by the handle, the bidirectional pawl is arranged to cause the main axle to rotate, and provides a first pawl and a second pawl which are opposite to the clutch direction between the ratchet wheel, and the working part further includes a direction switching mechanism for setting clutch direction of the bidirectional pawl and the ratchet wheel; the direction switching mechanism is arranged such that a first pawl and a second pawl are engaged with ratchet wheel selectively, such that when the handle is rotated in the direction set by the direction switching mechanism, the ratchet wheel is engaged with the bidirectional pawl, then rotates the main axle; when the handle is rotated in the direction opposite to the direction set by the direction switching mechanism, the ratchet wheel and the bidirectional pawl slide over each other, and the main axle remains stationary; the working part further includes a planetary gear speed increasing mechanism acting on the main axle, and the planetary gear speed increasing mechanism includes a sun gear, a planetary gear and a ring gear, in which the sun gear is arranged to rotate the main axle together, the rotation ring is arranged to cause the planetary gear to rotate, and the gear ring is fixedly connected with the handle, so that when the handle is gripped and the rotation ring is rotated, the planetary gear speed increasing mechanism increases the speed of the rotation inputted by the rotation ring and then the rotation is output via the main axle.

In a preferred embodiment of the invention, the ratchet wheel is arranged on the inner circumferential surface of the annular head part of the handle.

In another preferred embodiment of the present invention, the bidirectional pawl is installed on the main axle through pin shaft.

In another preferred embodiment of the present invention, the direction switching mechanism is a direction switching rod disposed through the main axle, the direction switching rod is equipped with a retractable bar cooperating with the bidirectional pawl, and inside the retractable bar is provided with a spring, so that the retractable bar can retract in the radial direction of the direction switching rod, when the direction switching rod is rotated, the retractable bar is rotated subsequently, in which the head part cooperates with the curved surface arranged on the bidirectional pawl under the bias of spring, the first pawl or the second pawl of the bidirectional pawl cooperates with the ratchet wheel selectively, thereby the clutch direction between the bidirectional pawl and the ratchet wheel is set.

In another preferred embodiment of the present invention, the head part of the retractable bar is hemispherical.

In another preferred embodiment of the present invention, the sun gear is fixedly connected with the main axle by screws.

In another preferred embodiment of the present invention, the gear ring and the handle are cooperatively connected with the blind hole through the protrusion.

In another preferred embodiment of the present invention, the planetary gear speed increasing mechanism increases the rotation speed inputted by the gear ring by four times and the rotation is output through the main axle.

When the wrench according to the present invention is in use, the outputted torque required by the wrench is small, users do not need to rotate the handle at this time but simply hold the handle and rotate the rotation ring by hands when tightening bolts at the initial stage under conditions of low torque output, the main axle will be rotated with higher speed than the rotation speed of the rotation ring, the rotation direction is the same as the rotation direction of the rotation ring, thus bolts can be tightened quickly; the outputted torque required by the wrench is large, users can preset the output direction of the main axle of wrench by rotating knob when tightening bolts on the final stage under conditions of high torque output, such as clockwise or counterclockwise. At this time if users rotate the handle in the set output direction, the main axle will be rotated in the direction at the same speed; if users rotate the handle in the opposite direction of the set output direction, the main axle remains stationary at this point.

A further description will be made as to the conception, detailed structure, and expected technical effects of the present invention with reference to the accompanying drawings to make the objects, features, and advantages of the present invention fully understandable.

DETAILED DESCRIPTION OF THE PREFERRED EMBODIMENTS

Figure 1:
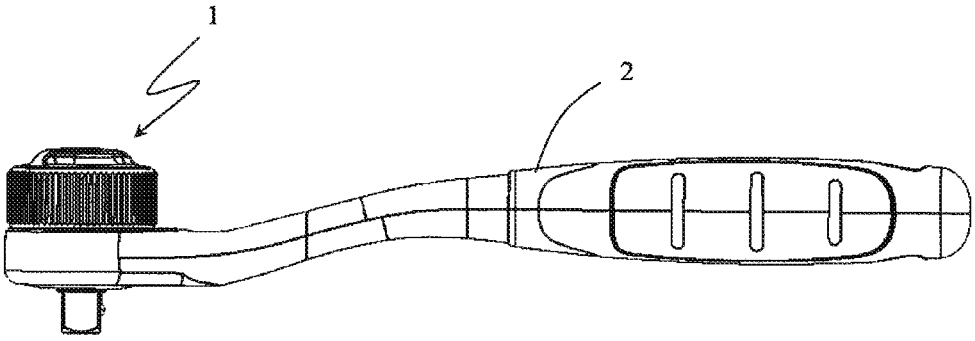
FIG. 1 is a front view of the wrench of a preferred embodiment of the present invention.
Figure 2:
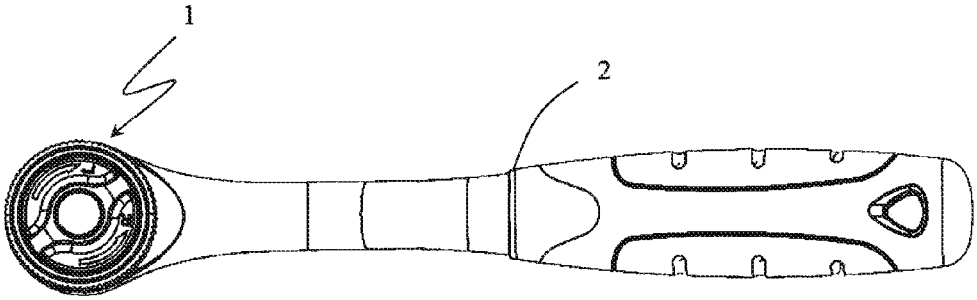
FIG. 2 is a top view of the wrench of a preferred embodiment of the present invention.
Figure 3:
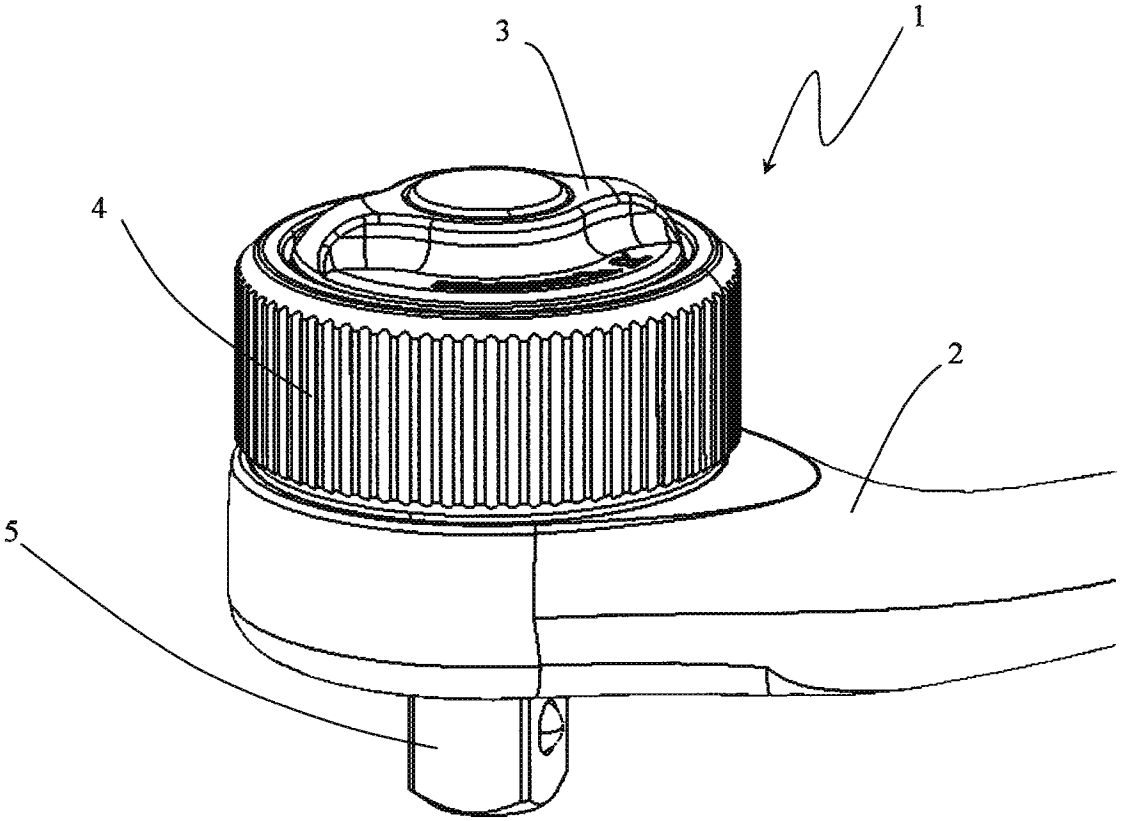
FIG. 3 is a working part of the wrench in FIGS. 1, 2.

FIG. 1, 2 show a front view and a top view of a wrench according to a preferred embodiment of the present invention, it can be seen that the wrench comprises a working part 1 and a handle 2, wherein the axis of the working part 1 is perpendicular to the handle 2. As shown in FIG. 3, the working part 1 has a knob 3, a rotating ring 4, an annular handle 2 sheathing outside of the working part 1, and a main axle 5 extending out from the working part 1 in the axial direction of the working part 1 in the present embodiment. The outputted torque required by the wrench is small, users do not need to rotate the handle at this time, by simply holding the handle 2 and rotate the rotation ring 4 by hands when tightening bolts at the initial stage under conditions of low torque output, the main axle 5 will be rotated with higher speed than the rotation speed of the rotation ring 4, the rotation direction is the same as the rotation direction of the rotation ring 4, thus bolts can be tightened quickly; the outputted torque required by the wrench is large, users can preset the output direction of the main axle 5 of the wrench by rotating the knob when tightening bolts on the final stage under conditions of high torque output, such as clockwise or counterclockwise. At this time if users rotate the handle 2 in the set output direction, the main axle 5 will be rotated in the direction at the same speed; if users rotate the handle 2 in the opposite direction of the set output direction, the main axle 5 remains stationary at this point. Below the specific configuration of the embodiment will be described in detail.

Figure 4:
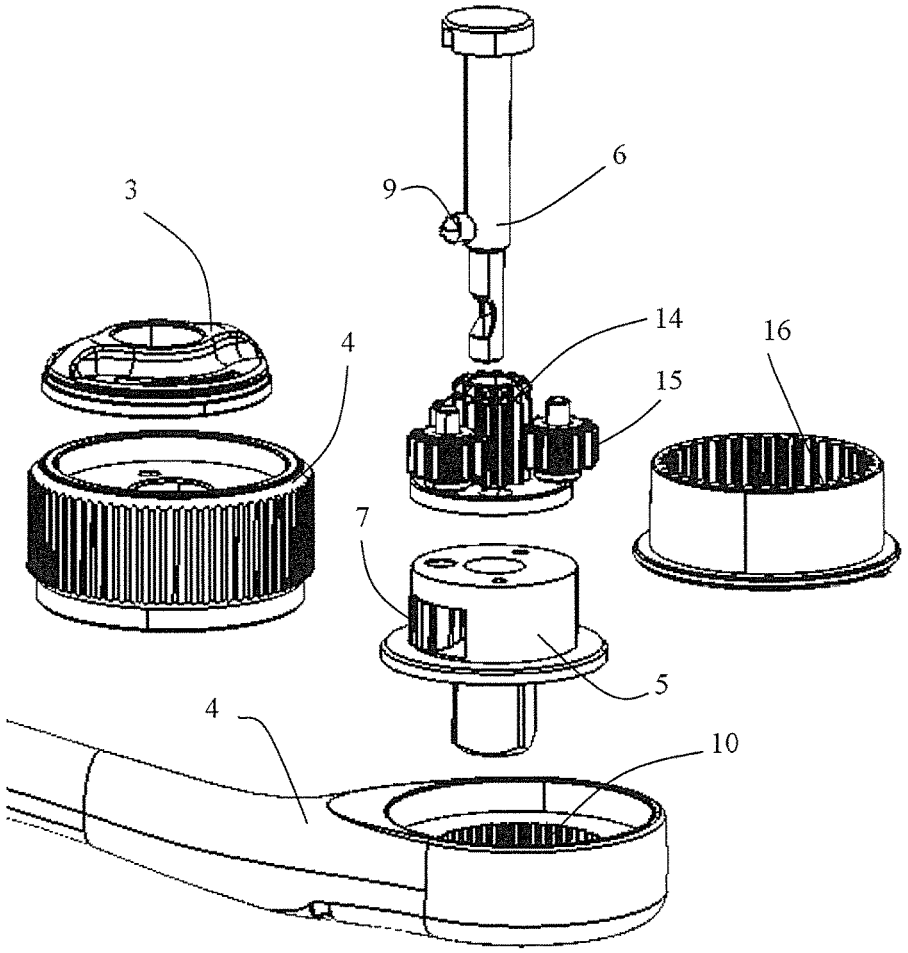
FIG. 4 is an exploded view of the working portion in FIG. 4.
Figure 5:
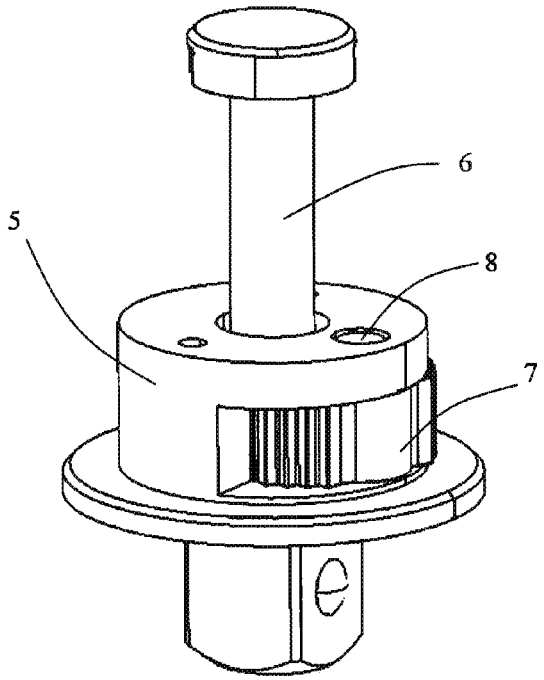
FIG. 5 is a partial assembly diagram of the working portion in FIG. 4.
Figure 6:
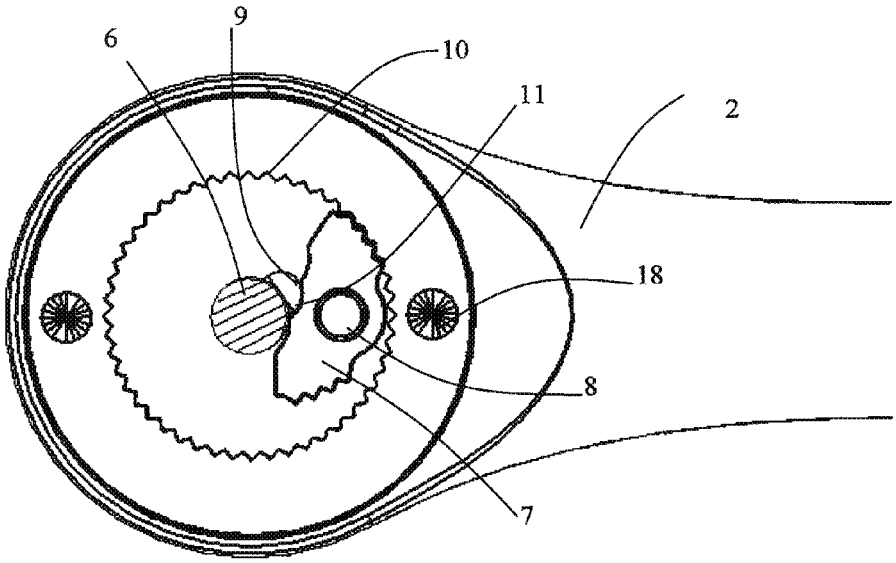
FIG. 6 is a partial assembly diagram of the working portion in FIG. 4.
Figure 7:
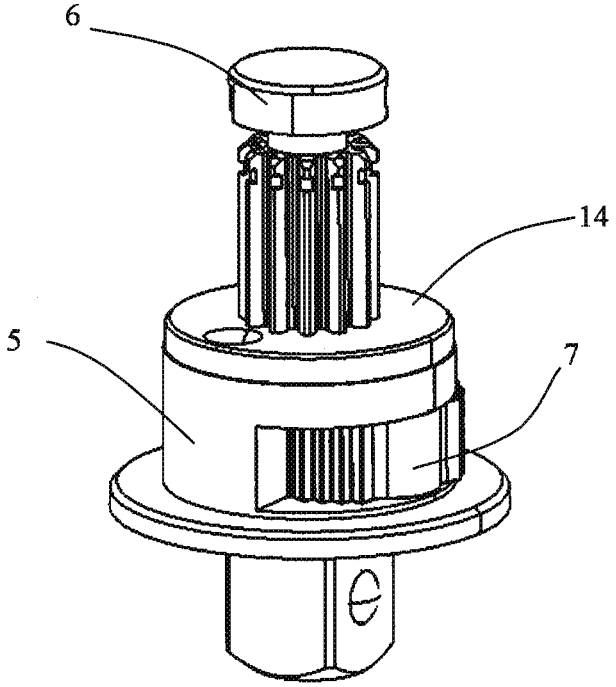
FIG. 7 is a partial assembly diagram of the working portion in FIG. 4.
Figure 8:
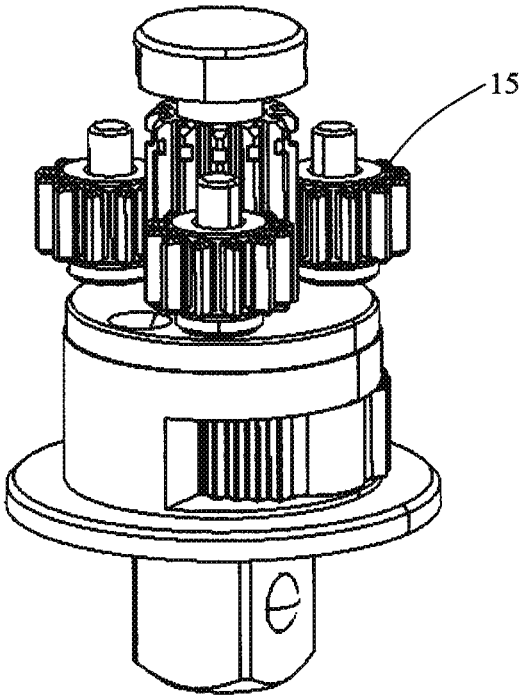
FIG. 8 is a partial assembly diagram of the working portion in FIG. 4.
Figure 9:
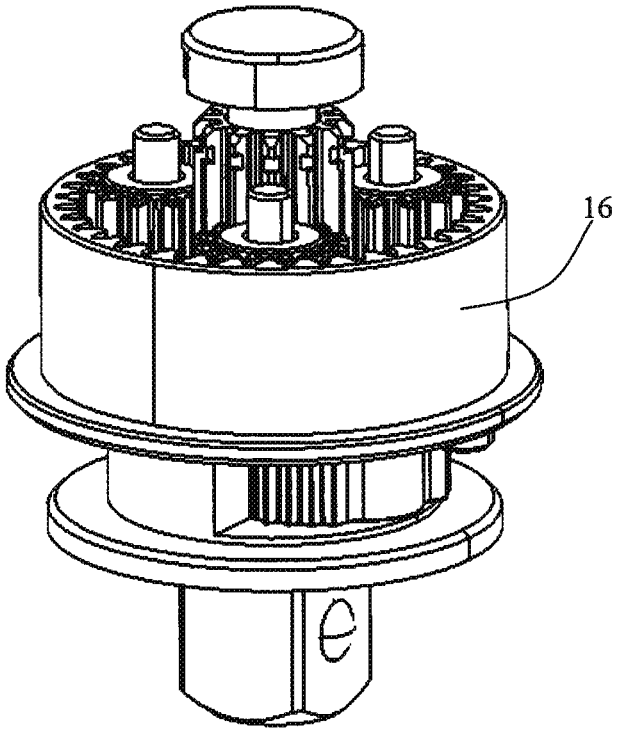
FIG. 9 is a partial assembly diagram of the working portion in FIG. 4.
Figure 10:
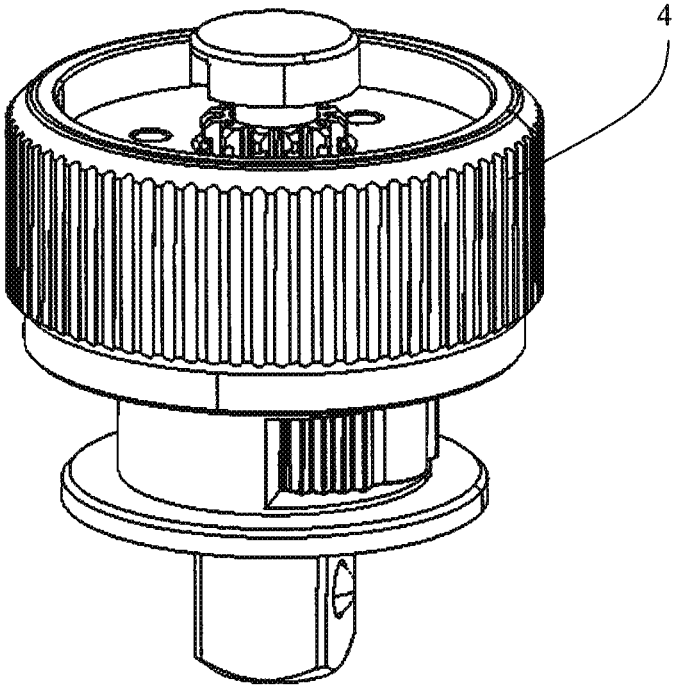
FIG. 10 is a partial assembly diagram of the working portion in FIG. 4.
Figure 11:
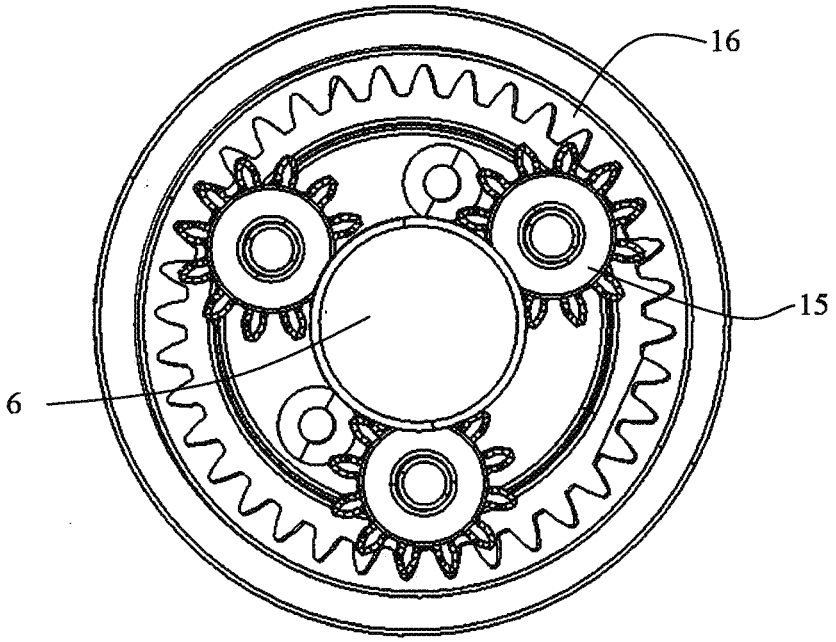
FIG. 11 is a top view of the speed increasing planetary mechanism in FIG. 4.
Figure 12:
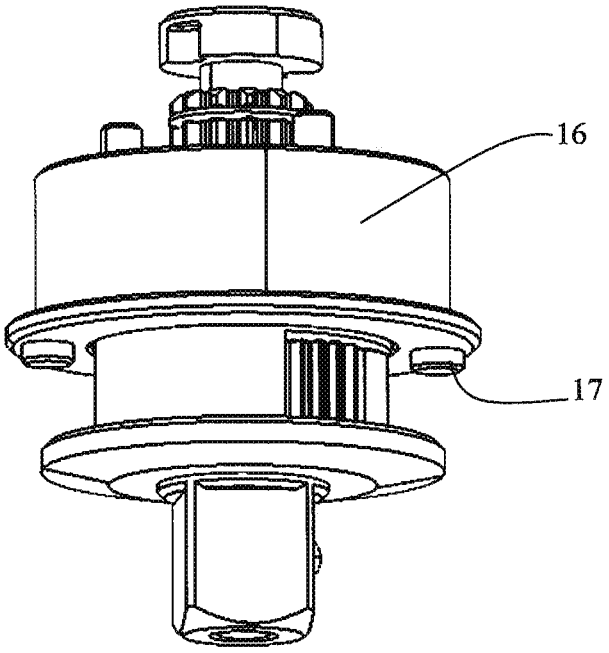
FIG. 12 is a partial assembly diagram of the working portion in FIG. 4.

The working part 1 includes a bidirectional pawl 7 cooperated with a ratchet wheel 10, and the ratchet wheel 10 is arranged so as to rotate with the handle 2, the bidirectional pawl 7 is arranged so as to cause the main axle 5 to rotate. Referring to the exploded view of the working part 1 in FIG. 3 as shown in FIG. 4, and FIG. 5, FIG. 6.

The ratchet wheel 10 is disposed directly on the inner circumferential surface of the annular head part of the handle 2 in the present embodiment. The bidirectional pawl 7 is installed on the main axle 5 through the pin shaft 8. The working part 1 also includes a direction switching mechanism for setting the clutch direction of the bidirectional pawl 7 and the ratchet wheel 10. The bidirectional pawl 7 has a first pawl 12 and a second pawl 13 that can coordinate with the ratchet wheel 10 respectively and has an opposite clutch direction in the present embodiment. The direction switching mechanism is a direction switching rod 6 disposed through the main axle 1. The direction switching rod 6 is connected to the knob 3, which is provided with a retractable bar 9 coordinated with the bidirectional pawl 7. The head part of the retractable bar 9 is hemispherical, inside which a spring is provided, so that the retractable 9 bar can retract in the radial direction of the direction switching rod 6. When the direction switching rod 6 is rotated via the knob 5, the retractable bar 9 rotates subsequently, in which the head part cooperates with a curved surface 11 arranged on the bidirectional pawl 7 under the bias of the spring, a first pawl 12 or a second pawl 13 of the bidirectional pawl 7 cooperates with the ratchet wheel 10 selectively, thereby the clutch direction between the bidirectional pawl 7 and the ratchet wheel 10 is set. When the handle 2 is rotated in the set direction, the ratchet wheel 10 is engaged with the bidirectional pawl 7 in the direction set by the direction switching rod 6, causing the main axle 5 to rotate and output torque; slipping in the opposite direction between the bidirectional pawl 7 while the main axle 5 remains stationary at this point.

As shown in FIGS. 7-11, the working part 1 also includes a planetary gear speed increasing mechanism acting on the main axle 5, the planetary gear speed increasing mechanism includes a sun gear 14, a planetary gear 15 and a ring gear 16, in which the sun gear 14 is arranged so as to cause the main axle 5 to rotate together, the gear ring 16 is fixedly connected with the handle 2, the rotation ring 4 is arranged so as to cause planetary gear 15 to rotate. When the handle 2 is gripped by hands and the rotation ring 4 is rotated, the gear ring 16 remains stationary, the planetary gear 15 inputs rotation, cause the sun gear 14 to rotate speed increasing, then causing the main axle 5 to rotate speed increasing. At this point the ratio of the rotation speed outputted by the main axle 5 and inputted by the rotation ring 4 is:

$$R=1+(N2/N1)$$

Where N2 is the number of teeth of the gear ring, N1 is the number of teeth of the planetary gear.

In this embodiment, the number of teeth of the gear ring 16 is 36, the gear of planetary gear 15 is 12, and therefore the planetary gear speed increasing mechanism increases the speed of the rotation speed inputted by the rotation ring 16 by four times and then output via the main axle 5.

In this embodiment, the sun gear 14 is fixedly connected with the main axle 5 by screws. As shown in FIG. 6, 12, the gear ring 16 and the handle 2 are cooperatively connected with the blind hole 18 through the protrusion 18.

The invention has been exemplified above with reference to specific embodiments. However, it should be understood that a multitude of modifications and varieties can be made by a common person skilled in the art based on the conception of the present invention. Therefore, any technical schemes, acquired by the person skilled in the art based on the conception of the present invention through logical analyses, deductions or limited experiments, fall within the scope of the invention as specified in the claims.

The invention claimed is:

1. A wrench, comprising a working part and a handle, characterized in that, the working part comprises a main axle, a bidirectional pawl and a ratchet wheel, the main axle is perpendicular to the handle, and the bidirectional pawl and the ratchet wheel are mutually cooperated, wherein the ratchet wheel is arranged to be caused by the handle, the bidirectional pawl is arranged to cause the main axle to rotate and provides a first pawl and a second pawl which are opposite to the clutch direction between the ratchet wheel, and the working part further comprises a direction switching mechanism for setting the clutch direction of the bidirectional pawl and the ratchet wheel; the direction switching mechanism is arranged such that the first pawl and the second pawl are engaged with the ratchet wheel selectively, such that when the handle is rotated in the direction set by the direction switching mechanism, the ratchet wheel is engaged with the bidirectional pawl, then causes the main axle to rotate; when the handle is rotated in the direction opposite to the direction set by the direction switching mechanism, it slips between the ratchet wheel and the bidirectional pawl, and the main axle remains stationary;

wherein the direction switching mechanism is a direction switching rod disposed through the main axle, the direction switching rod is equipped with a retractable bar cooperating with the bidirectional pawl, and a spring is provided inside the retractable bar, so that the retractable bar can retract in the radial direction of the direction switching rod, when the direction switching rod is rotated, the retractable bar is rotated subsequently, the head part thereof cooperates with a curved surface arranged on the bidirectional pawl under the bias of the spring, the first pawl or the second pawl of the bidirectional pawl cooperates with the ratchet wheel selectively, thereby the clutch direction between the bidirectional pawl and the ratchet wheel is set;

the working part further comprises a planetary gear speed increasing mechanism acting on the main axle, and the planetary gear speed increasing mechanism comprises a sun gear, a planetary gear and a ring gear, wherein the sun gear is arranged to cause the main axle to rotate together, the rotation ring is arranged to cause the planetary gear to rotate, and the gear ring is fixedly connected with the handle, so that when the handle is gripped and the rotation ring is rotated, the planetary gear speed increasing mechanism increases the speed of the rotation inputted by the rotation ring and then the rotation is output via the main axle.

2. The wrench of claim 1, wherein the ratchet wheel is arranged on the inner circumferential surface of the annular head part of the handle.

3. The wrench of claim 1, wherein the bidirectional pawl is installed on the main axle through a pin shaft.

4. The wrench of claim 1, wherein the head part of the retractable bar is hemispherical.

5. The wrench of claim 1, wherein the sun gear is fixedly connected with the main axle by screws.

6. The wrench of claim 1, wherein the gear ring and the handle are cooperatively connected with the blind hole through a protrusion.

7. The wrench of claim 1, wherein the planetary gear speed increasing mechanism increases the rotation speed inputted by the gear ring by four times and the rotation is output through the main axle.

* * * * *